United States Patent [19]

Schetrumpf

[11] Patent Number: 4,572,187

[45] Date of Patent: Feb. 25, 1986

[54] ABRASION DEVICE

[76] Inventor: John R. Schetrumpf, 12, Ladbroke Sq., London, W. 11, England

[21] Appl. No.: 586,747

[22] Filed: Mar. 6, 1984

[30] Foreign Application Priority Data

Mar. 11, 1983 [GB] United Kingdom ..... 8306678

[51] Int. Cl.[4] ..... A01B 17/00

[52] U.S. Cl. ..... 128/355; 51/336

[58] Field of Search ..... 51/334, 336, 337; 128/355

[56] References Cited

U.S. PATENT DOCUMENTS 2,867,214 1/1959 Wilson ..... 128/355

4,133,146 1/1979 De Cola ..... 51/336

*Primary Examiner*—Robert Peshock

*Attorney, Agent, or Firm*—Dennison, Meserole, Pollack & Scheiner

[57] ABSTRACT

A device suitable for use in the surgical procedure of dermabrasion comprising a rotary hub and a plurality of flexible strips each of which has a single abrasive surface, the strips being located with respect to the hub at or adjacent ends or edges of the strips to extend outwardly of the hub at spaced locations around the periphery thereof with the abrasive surfaces of the strips facing in the same peripheral direction around the hub.

15 Claims, 4 Drawing Figures

ABRASION DEVICE

FIELD AND BACKGROUND OF THE INVENTION

This invention concerns an abrasion device which may be used in the surgical procedure of dermabrasion.

Dermabrasion constitutes an established surgical method for improvement of skin contour by purposeful abrasion of the skin to one of its constituent levels known as the dermis, and such action is known by this name.

The physical means of achieving this at present are via abrasive pads which are hand held or rotating wire brushes or abrasive drums which are moved across the skin in a stroking motion so as to remove irregularities when these are proud of the general skin contour or to reduce the skin thickness to meet the level of irregularities when these are below the skin surface as in the case of pits and pocks.

Use of hand held pads incur excessive hand supportive manipulation of the involved tissues with difficult control of these tissues and this can result in inaccurate execution of the procedure. Furthermore this is time consuming and by virtue of this can result in a weakening of the effect of a local anaesthetic agent when this has been used, or cause more of this to be used than otherwise might be necessary and in the case where general anaesthesia has been used result in prolonging such anaesthesia and increasing the risks attached thereto.

In the case of the above mentioned rotary devices used for the purpose of dermabrasion these have relatively rigid forms compared to the skin surface on which they are meant to act and can themselves impose unsightly contour defects on the softer skin surface, which is hereinafter referred to as contouring, guttering or grooving, and this constitutes an undesirable feature of these devices.

A centrifugal dermabrader, in accordance with the invention makes it possible to provide rotary dermabrasion with a gentler action, greater control of the depth of dermabrasion and with reduced risk of undesirable contouring or guttering occuring.

SUMMARY OF THE INVENTION

The invention provides a device suitable for dermabrasion, which device comprises a rotary hub and a plurality of flexible strips each having a single abrasive surface, the strips being located and fixed with respect to the hub at or adjacent ends or edges of the strips to extend outwardly of the hub at locations, preferably spaced, around the periphery thereof, with the abrasive surfaces of the strips all facing in the same peripheral direction around the hub.

The hub may be a cylindrical member with a drive shaft projecting axially from one end thereof.

Preferably, the hub is a moulded member, made for example of a plastics material, with end or edge portions of said strips embedded therein. In such embodiments an end portion of said drive shaft may also be embedded in the moulded hub.

The invention also provides an abrasion device comprising a rotary hub having a hollow end portion and a plurality of slots through the wall of said hollow end portion at spaced positions, preferably equally spaced, therearound suitable to receive end or edge portions of respective abrasive strips, a plug member for engagement in said hollow end portion, the plug member being dimensioned to trap end or edge portions of the abrasive strips located, in use, in said slots and projecting into the hollow interior of said hub end portion, and means to locate the plug member on the hub so as to trap the strips as aforesaid.

Said plug member may have an externally threaded end portion which cooperates with an internally threaded bore in the blind end of said hollow end portion of the hub to locate the plug member thereon. The plug member may have a shank which tapers progressively towards its end to bind and secure end or edge sections of abrasive strips projecting into the hollow interior of said hub end portion.

Preferably, said slots extend from the open end of said hollow hub end portion, the head of the plug member and the wall of the hub end portion at its open end having cooperating frusto-conical surfaces such that, when the plug member is fully inserted in the hollow hub end portion, the engagement of the said frusto-conical surfaces causes inward flexing of the wall portions of said hub end portion between said slots therein thereby tending to close the slots and to grip more firmly portions of abrasive strips located, in use, in the slots.

Advantages of the invention are that it makes it possible to provide a dermabrader having components which are supported by centrifugal force due to the rotary action such that when it is brought against the skin surface these abrasive components are not rigid but are deformed by the skin contour to the shape thereof whereby abrasion of the skin surface occurs in a mamnner determined by this form alone, and not a round form which the circular action of the mechanism would suggest and as is the case in the known rigid abrasive devices described above.

Unlike the more rigid rotary mechanisms the abrasive action of a device according to the invention is parallel to the skin contour against which it is applied and because of the relatively larger surface of the abrasive surface of such a device focal pressure does not result so that the undesirable effect of guttering and/or grooving the skin is less likely to occur.

The pressure which the cushion of abrasive action effects against and parallel to the skin surface and which is determined by the flexibility of the abrasive components and the centrifugal force of these from their rotation, is able to be modified over a great range through modification of the rotational speed and the degree of closeness of application.

Such facility to alter the pressure at which abrasive action occurs means that a smooth and natural transition of abrasive action from the treated area of skin irregularity to the surrounding normal skin can be easily achieved.

Application of the rigid conventional rotation devices to achieve this smooth transition zone is difficult and often in definitive surgical terms results in a tell tale edge at the perimeter of the treated area.

BRIEF DESCRIPTION OF THE DRAWINGS

Embodiments of the invention will now be described by way of example and with reference to the accompanying drawings, in which.

DETAILED DESCRIPTION

Figure 1:
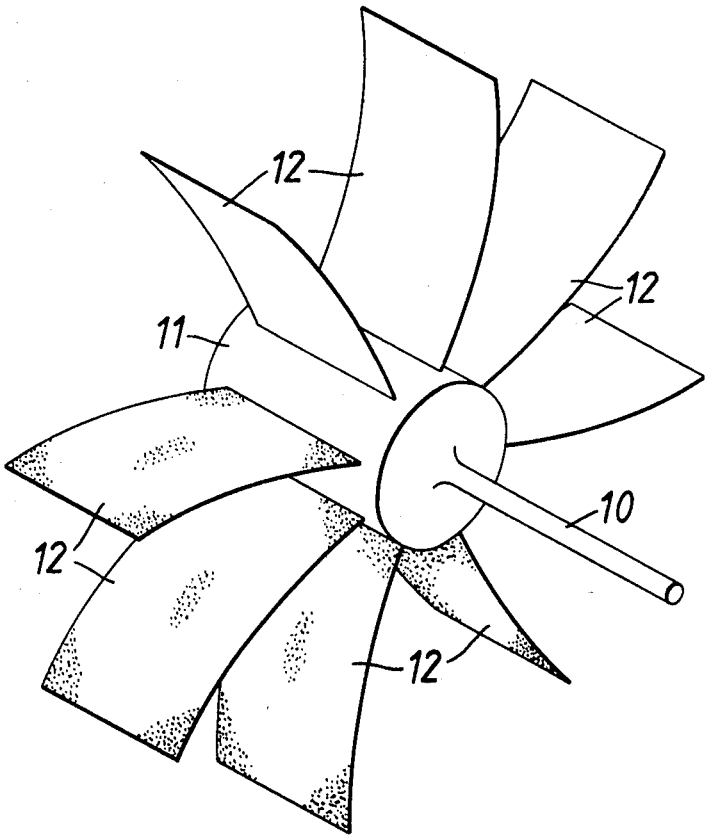
FIG. 1. is a perspective view of a dermabrader embodying the invention

Referring to FIG. 1, a dermabrader embodying the invention comprises a cylindrical hub (11) having a drive shaft (10) projecting axially from one end thereof. A number of strips of flexible material (12), which have an abrasive on one side only thereof, are fixed at one end thereof at equally spaced locations around the periphery of the hub to extend outwardly thereof. Eight such strips are used in the present embodiment but any number greater than one can be employed.

Conveniently the hub is moulded from a suitable material, e.g. a plastics material, to provide a very smooth surface which is known to be relatively inert in relationship to contact with the skin or other body tissue. A suitable plastics material is medical grade polypropylene. An end portion of the shaft (10), which is knurled or flattened, is embedded in this moulding as well as the end or edge portion of the flexible abrasive sheets, the roughened or abrasive aspect of which provides additional purchase.

The abrasive sheets (12) are identical in shape and abrasive quality. They must be flexible and may be made from thin metal, woven material, paper or any homogeneous material such as plastic. It is essential that the abrasive surface has good integrity providing high stability and function in the wet conditions of freely bleeding skin and may take the form of abrasives bonded onto the above mentioned sheeting or in the case of metal sheeting this may be made abrasive by multiple puncture from one aspect or by other working of the metal surface. By 'high stability' I mean high particle cohesion so as to prevent during use any danger to the surgeon's eyes of wound contamination by providing a high resistance to disintegration of the abrasive in use. It is important that the bonding materials and the abrasives which are bonded, are relatively insoluble in blood or aqueous solutions so that centrifugal force does not make the use of the device over-hazardous and that these should be absent of or have low tissue toxicity and be non-allergenic. Non-allergenicity or relative non-allergenicity is important to avoid the skin reactions at the time of surgery or afterwards in the healing phase.

For the purposes of essential sterility the components of the device are to be made of materials which are sterilizable by conventional means. The device as shown in FIG. 1, may be manufactured so the device is sterile and/or disposable ready for use.

In preferred, but not necessarily all embodiments of the invention, the plurality of flexible strips are spaced around the hub so that their disposition around the hub does not cause the strips to impinge on one another at the hub circumference, whereby there is a section of hub circumference between each strip. This spacing allows better flexing of the individual strips closer to the hub than would otherwise occur and this means that for a given length of strip more of the strip remains available for exposure to the skin for abrasion and also improves the ability of the strips to conform to the contour of the skin. This effect on the single flexible strips enhances colllectively the facility of the surgical instrument to provide gentle and contour conforming abrasiveness which is vital to the surgical operation of dermabrasion.

Such spacing also allows easier cleaning of the surgical instrument during or at the end of an operation where in the latter case, the instrument is being kept for reuse. Moreover, the spacing allows for easier ingress of codant and/or lubricant and the egress of blood and skin debris during use.

The restricted number of flexible abrasive strips means that for a given length of strip a larger cutting surface area of each abrasive strip comes into contact with the skin without interruption from an excessive overlapping of the strips as would occur if these are large in number.

Overlapping of a number of adjacent strips at the interface between the skin and the abrasive tends to result in a stepped or less smooth abrasive sweep and increases the rigidity of the strips, thereby reducing their ability to conform to the skin contour. A restricted number of spaced apart strips therefore improves the ability of the instrument to conform to the skin contour by providing a flatter abrasive surface since larger surface areas of each strip are able to contact the skin, by providing an abrasive structure having substantially less rigidity. Moreover, this structure means that there will be less likelihood of fragmentation at the tips of each tips which is more likely to occur with closely packed strips, with a greater degree of overlap thereof during abrasion which therefore takes place at the tip region of the individual strips.

In preferred embodiments a typical number of flexible strips is likely to be in the range of six to twelve.

It is also preferred that an even number of equally spaced strips are provided because if one strips becomes damaged causing the instrument to vibrate in subsequent operation, the diametrically opposed strip can be removed in order to restore the rotary dynamic balance of the instrument.

The face is the main area in which dermabrasion is performed and in keeping with the size and intricasies of this site a general range of hub sizes is noted below.

General range of hub sizes:

Diameter: 0.75 cms–2.5 cms.

Length: 1.00 cms–3.0 cms.

However, treatment of areas such as the back might necessitate versions of the device that are larger than those encompassed by this range.

Figure 2:
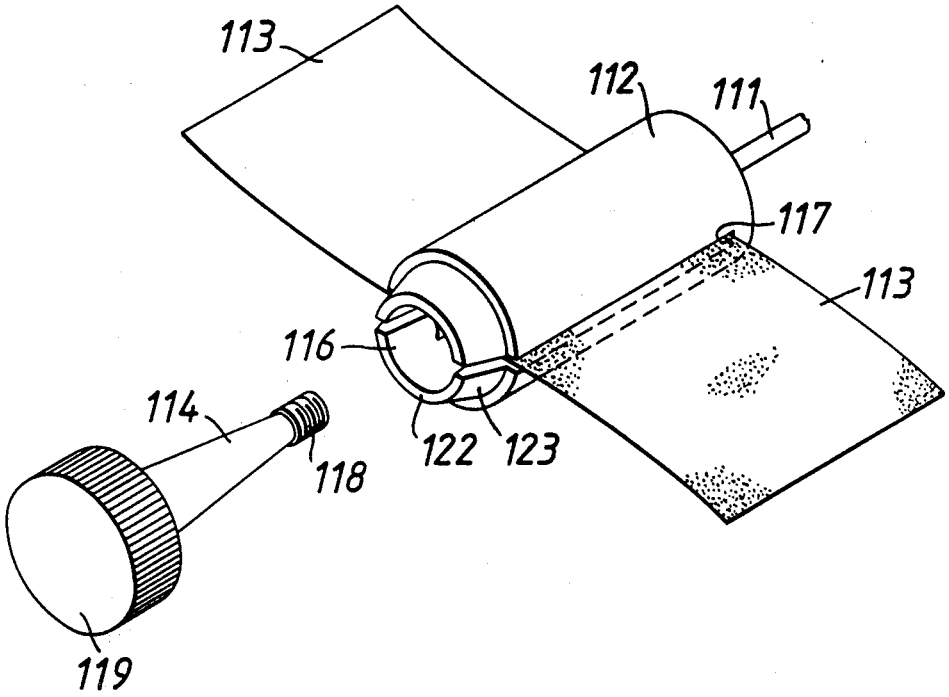
FIG. 2. is a perspective of a second embodiment.

No range of sizes is envisaged for the device as shown in FIG. 2. as this would restrict the 'multiplicity of use', a feature in the design of the device.

The dimensions of a specific model of the device as shown in FIG. 1. are:

Hub:

diameter 1.6 cms.

length 2.2 cms.

Abrasive sheet:

length from hub 2.2 cms.

width (along hub) 1.4 cms.

The effect of the length of the abrasive sheets in a direction from the hub attachment to their free ends is, up to point, to increase the range of pressure of the abrasive cushion which is formed during use and the degree of ability of this to conform to the contour of the surface to be abraded. In practical terms the effect is to increase the capacity of the device to feather in or create a smooth transition from the treated area to the surrounding area which does not require treatment. The dimensions of the above specific model embraces a successful ratio of hub diameter to length of abrasive sheet measured from the hub attachment to the free end.

Similarly, to the above, the stiffness, thickness or weight of the abrasive sheeting or variation of any of these modalities through the substance of the said abrasive sheeting, especially where this occurs parallel to the axis of rotation, under the action of centrifugal force that can be varied and effected by this device, offers a considerable facility for selecting the best combination of contouring and abrasive effect.

As noted above FIGS. 2 to 4 illustrate another embodiment of the invention. The abrasive device of this embodiment is is adapted to accept abrasive sheets of different grades of abrasiveness and size and to permit them to be interchanged as required. The sheets could be selected from a range made available to an operator to enable him to cope with dermabrasion problems of different or special dimensions. This extra facility extends the variation and applications for which the device can be used in operation not only in dermabrasion but also for abrasive action for non-medical purposes and such later uses are inclined within the scope of the invention.

Figure 3:
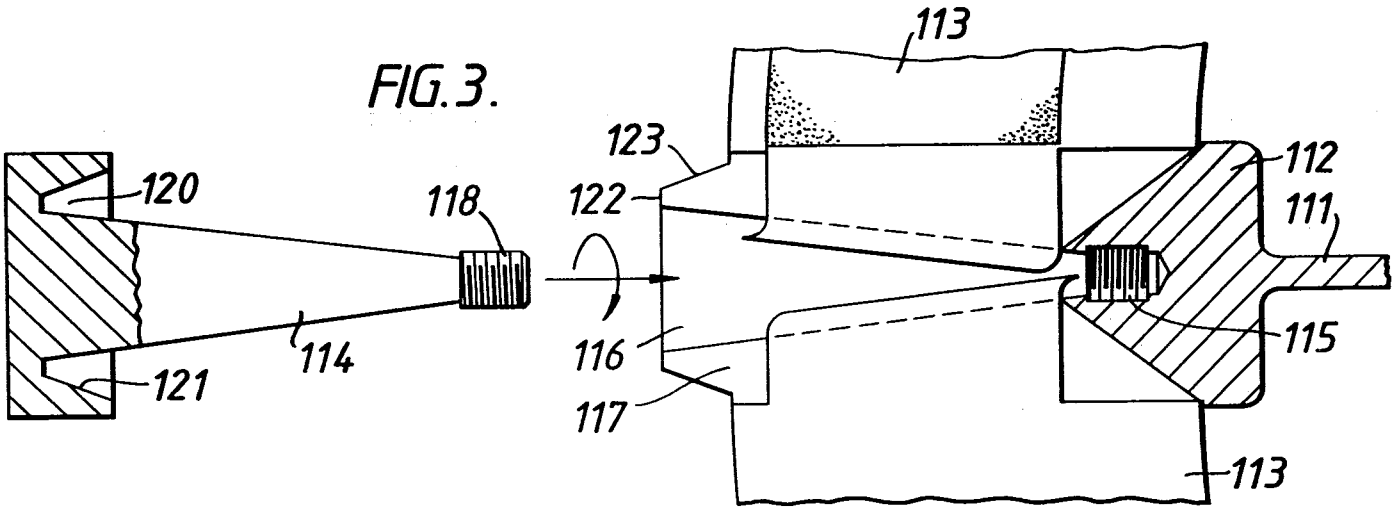
FIG. 3. is a diagrammatical sectional view of the device of FIG. 2.
Figure 4:
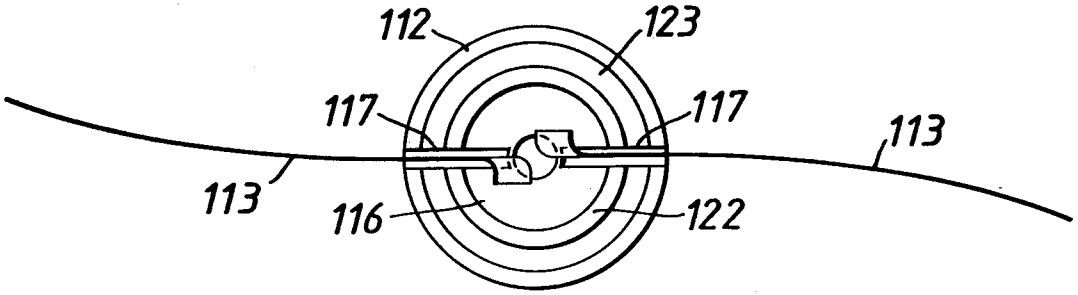
FIG. 4. is an end view of the hub assembly of the device of FIGS. 2 and 3.

The abrasion device of FIGS. 2 to 4 comprises a hub (112) and an integral drive shaft (111) as in the first embodiment. However the hub (112) is adapted to receive separate strips of abrasive material (113). The hub (112) has a hollow end portion (116), open at the end of the hub remote from the drive shaft (111). The annular wall of this hub portion (116) is formed with a series of evenly spaced, axial slots (117) extending from the open end of the hollow hub portion (116). An end portion of each strip (113) is bent at right angles, as seen in FIG. 4, and is then inserted in a respective slot (117) in the hub.

In the illustrated embodiment only two abrasive sheets are employed for clarity. Devices according to the invention work well even if only a small number of abrasive sheets are used so long as they are equal size and more than one such sheet is used, preferably evenly spaced around the periphery of the hub.

A tapered pin (114) is provided to secure the abrasive sheets (113) in the hub. An end portion (118) of the pin has an external screw thread for cooperating with an internally threaded bore (115) provided in the blind end of the hollow interior of of hub portion (116) to secure the pin to the hub. The head of the pin is knurled to facilitate tightening of the pin in the threaded bore (115). The underside of the head (119) of the pin is formed with an annular recess (120) having an outer frusto-conical side surface (121). The free end of the hub portion (116) is formed with a reduced diameter section (122) having a frusto-conical outer peripheral surface (123) to cooperate with the frusto-conical surface (121) on the head of the pin when the pin is secured to the hub (112).

The purpose of the tapered shank (114) is to bind the turned over portions of the abrasive sheeting when the pin is fitted into the hollow end portion of the hub. The purpose of the cooperating frusto-conical surfaces (121 and 123) on the pin and hub respectively is to cause the portions of the wall of the hub between the slots (117) to close and thereby to firmly grip the abrasive sheets disposed therein.

The direction of rotation of the hub (112) will usually be clockwise so it is important that the thread (118) on the pin (114) is a conventional right-hand screw-thread so that the inertia of the pin, when it rotates, will tend to tighten and not loosen the pin.

The knurled section of the pin and the end of the drum should have no sharp or abrasive edges that can cut skin or damage the surface which is being abraded.

I claim:

1. A dermabrader comprising a rotary hub made of a material which is relatively inert in relationship to contact with skin or other body tissue, and a plurality of flexible strips having a single abrasive surface of high stability and which has no or little body tissue toxicity and is relatively non-allergenic, the strips being located and fixed with respect to the hub at or adjacent ends or edges of the strips to extend outwardly of the hub at locations around the periphery thereof with the abrasive surfaces of the strips facing in the same peripheral direction around the hub, each flexible strip being dimensioned in length and thickness to flex to a position substantially parallel to the surface to be abraded and remain out of contact with each other at the hub.

2. A dermabrader according to claim 1, wherein said locations are spaced around the periphery of the hub.

3. A dermabrader according to claim 2, wherein said locations are equally spaced around the periphery of the hub.

4. A dermabrader according to claim 3 wherein an even number of said strips are provided.

5. A dermabrader according to claim 1 wherein said hub is generally cylindrical with a drive shaft projecting axially from one end thereof.

6. A dermabrader according to claim 1 wherein the hub is a moulded member with end or edge portions of said strips embedded therein.

7. A dermabrader according to claim 6 wherein said hub is made of a plastics material.

8. A dermabrader according to claim 6 wherein an end portion of a drive shaft is also embedded in the moulded hub coaxially therewith.

9. A dermabrader according to claim 1 wherein the diameter of said hub is in the range of 0.75 cms–2.5 cms and the axial length of the hub is in the range 1 cm–3 cms.

10. A dermabrader according to claim 1 wherein each strip comprises a support sheet having an abrasive material bonded to one side thereof, the abrasive and bonding materials being relatively insoluble in blood or aqueous solutions.

11. A abrasive device comprising a rotary hub having a hollow end portion and a plurality of slots through the wall of said hollow end portion at spaced positions therearound suitable to receive end or edge portions of each of a plurality of respective flexible abrasive strips, a plug member for engagement in said hollow end portion, the plug member being dimensioned to trap end or edge portions of the abrasive strips located, in use, in said slots and projecting into the hollow interior of said hub end portion, and means to locate the plug member on the hub so as to trap the strips as aforesaid, each flexible strip being dimensioned in length and thickness to flex to a position substantially parallel to the surface to be abraded and remain out of contact with each other at the hub.

12. A device according to claim 11 wherein said portions are equally spaced around said hollow end portion of the hub.

13. A device according to claim 11 wherein said plug member has an externally threaded end portion which cooperates with an internally threaded bore in the blind end of said hollow end portion of the hub to locate the plug member thereon.

14. A device according to claim 11, wherein the plug member has a shank which tapers progressively towards its end to bind and secure end or edge sections of abrasive strips projecting, in use, into the hollow interior of said hub end portion.

15. A device according to claim 11, wherein said slots extend from the open end of said hollow hub end portion, the head of the plug member and the wall of the hub end portion at its open end having cooperating frusto-conical surfaces whereby, when the plug member is fully inserted in the hollow hub end portion, the engagement of the said frusto-conical surfaces causes inward flexing of the wall portions of said hub end portion between said slots therein thereby tending to close the slots and to grip more firmly portions of abrasive strips located, in use, in the slots.

* * * * *